United States Patent [19]

Diaz

[11] Patent Number: 4,634,368

[45] Date of Patent: Jan. 6, 1987

[54] APPARATUS FOR IMPROVING THE SURFACE CHARACTERISTICS OF WAXY MATERIALS

[75] Inventor: Manuel Diaz, Point Pleasant, N.J.

[73] Assignee: Fluid Packaging Company, Inc., Lakewood, N.J.

[21] Appl. No.: 609,528

[22] Filed: May 14, 1984

Related U.S. Application Data

[63] Continuation-in-part of Ser. No. 393,642, Jun. 30, 1982, abandoned.

[51] Int. Cl.[4] ..... A01J 15/14

[52] U.S. Cl. ..... 425/453; 264/102; 264/210.5; 425/73; 425/74; 425/445; 425/446; 425/DIG. 32; 432/82; 432/146; 432/148; 432/161

[58] Field of Search ..... 264/65, 102, 210.5, 264/234, 237, 267, 268, 344, 345, 346, DIG. 7 B; 425/445, 446, DIG. 32, DIG. 60, 73, 74, 453; 432/82, 146, 148, 161

[56] References Cited

U.S. PATENT DOCUMENTS

| | | | |
|---|---|---|---|
| 1,658,332 | 2/1928 | Hanley | 432/82 |
| 3,172,647 | 3/1965 | Remmey | 432/145 |
| 3,184,224 | 5/1965 | Shelley | 432/82 |

*Primary Examiner*—Donald Czaja
*Assistant Examiner*—Harold Y. Pyon
*Attorney, Agent, or Firm*—Laughlin, Markensohn, Lagani & Pegg

[57] ABSTRACT

An apparatus and method for improving the surface characteristics of wax-based material such as a deodorant or anti-perspirant stick housed in a container is provided. The apparatus comprises a hollow walled housing having an inlet and outlet portion. A plurality of rows of horizontally mounted endless conveyors each comprised of a plurality of interconnected conveyor feet are mounted in the housing for moving containers therethrough in reciprocating fashion. A plurality of spaced separators are mounted between the rows and containers move sequentially through these rows from the inlet to the outlet of the housing. A duct system is connected with the housing for circulating air through the housing and creating a reduced pressure therein. A plurality of heating units arranged in sequence are mounted over the rows which units are capable of melting the wax-based material. As containers of waxy material move under each heating unit the wax-based material surface is melted and then allowed to resolidify thereafter. After all meltings by the units and resolidifications of the material the surface characteristics are dramatically improved.

17 Claims, 4 Drawing Figures

APPARATUS FOR IMPROVING THE SURFACE CHARACTERISTICS OF WAXY MATERIALS

This is a Continuation-in-part of Ser. No. 393,642, filed on June 30, 1982 abandoned.

BACKGROUND OF THE INVENTION

This invention is concerned with an apparatus and method for improving the characteristics of waxy material, particularly wax-based stick applicators.

Many cosmetic and personal care items such as lipsticks, deodorants and anti-perspirants are produced in so-called stick form, which stick comprises a substantial quantity of low melting waxy material and substances to be applied to the surface of the body, e.g. essential oils and perfumes. Such sticks are sold in cylindrical containers and can be elevated above the container level for application to the body and then lowered again. One such cylindrical container has a hollow shell in which is mounted an externally threaded shaft. The shaft extends through the bottom of the hollow shell where it is connected to a rotatable base. A shallow dish having an internally threaded central aperture is placed on the shaft at the bottom of the hollow portion. The container is filled by introducing a liquid formulation of the product into the hollow shell at an elevated temperature. Thereafter, the formulation is allowed to cool and solidify. The solidified wax-based product rests on the shallow dish and as the base is rotated, the dish is threaded upwardly on the shaft and the stick carried by it is raised to a level sufficient for application.

In order to make the product more appealing to the consumer it is desirable that the surface of the waxy material be smooth and uniform and throughout its service life and initially substantially level.

Unfortunately, after filling the containers with the liquid formulation and allowing solidification, the solidified the stick very often contains small air-entrapped bubbles and a central hollow nodule formed as a consequence of the solidification of waxy material above and around the central shaft. The waxy material also adheres to the top inside surface of the container above the level of the bulk of the material thus creating an undesired meniscus. Such air spaces appear as the stick is used up and create an undesirable product. It is an object of the present invention to provide an apparatus and method for significantly improving the characteristics of waxy material by removing undesirable imperfections.

It is an object of the invention to provide an apparatus and process in which waxy material is sequentially melted and resolidified a number of times under controlled pressure conditions thereby smoothing the surface and eliminating any bubbles and nodules from the composition and the adherence of the waxy material to the sides of the container.

SUMMARY OF THE INVENTION

The apparatus of the present invention comprises a hollow walled housing in which a plurality of rows of endless conveyor belts are mounted horizontally. Conveyor belts in adjacent rows move in opposite directions to obtain maximum utilization of space. The conveyor belts divide the housing into upper and lower chambers. A plurality of air ducts are located along the longer side walls of the housing comprised of an inlet section and an outlet section, the inlet section being connected with the upper chamber and the outlet section being connected with the lower chamber. Both the inlet and outlet sections are joined at the top of the housing and communicate with the atmosphere through an air conduit. Air control means such as louvres are located in the inlet and the air conduit. An air circulating means such as a blower is located in the outlet section. During operation of the blower the air control means in the inlet section can be adjusted so that a reduced pressure is created in the upper and lower chambers, this pressure being equalized by air spaces between the conveyor belt feet. This reduced pressure is essential to the invention to produce a uniform product free of imperfections. The degree of reduced pressure will depend on the speed in which the operation is to be carried out. The pressure, however, cannot be reduced to a point where the liquefied waxy material is drawn from the container. This lower range will depend on the viscosity of the composition. By adjusting the air control means in the air inlet section to cut off admittance of external air, air can be recirculated in the housing through the inlet and outlet sections. Heat exchanger units are located in the lower chamber for heating or cooling air circulated through the housing. A number of separator guides are mounted between the alternately moving conveyor belts to form a plurality of rows. Containers containing the wax-based stick material enter the first row at the inlet side of the housing, thereafter moving on the conveyors through the rows in reciprocating fashion from one end of the housing to the other toward the outlet where they exit.

In the upper chamber are a plurality of heating or remelt units mounted above the rows and arranged in sequence from the inlet to the outlet capable of melting the wax-based material preferably arranged in order of decreasing temperature from the inlet to the outlet of the housing, each being spaced apart a distance sufficient to allow solidification of wax-based material in each container after each melting.

In operation, a container is filled with a wax-based material having air spaces throughout the composition. The container, is moved by a conveyor into the housing and the atmosphere is maintained at the reduced pressure in the chamber. The wax-based material is then subjected in the chamber to a melting temperatures of the first heating unit whereby the composition is melted. After moving past the first heating unit the surface is allowed to resolidify and is then subjected to second and succeeding heating units where remelting and resolidification takes place stepwise. It is preferred that the solidification takes place at least twice. After the final remelt and resolidification the surface of the wax-based material is smooth, and the composition contains no miniscus or a central nodule and has no air bubbles. A similar treatment without the reduced pressure resulted in an unsuitable product containing air bubbles. A similar treatment without the reduced pressure resulted in an unsuitable product containing air bubbles.

DETAILED DESCRIPTION OF THE PREFERRED EMBODIMENTS

Figure 1:
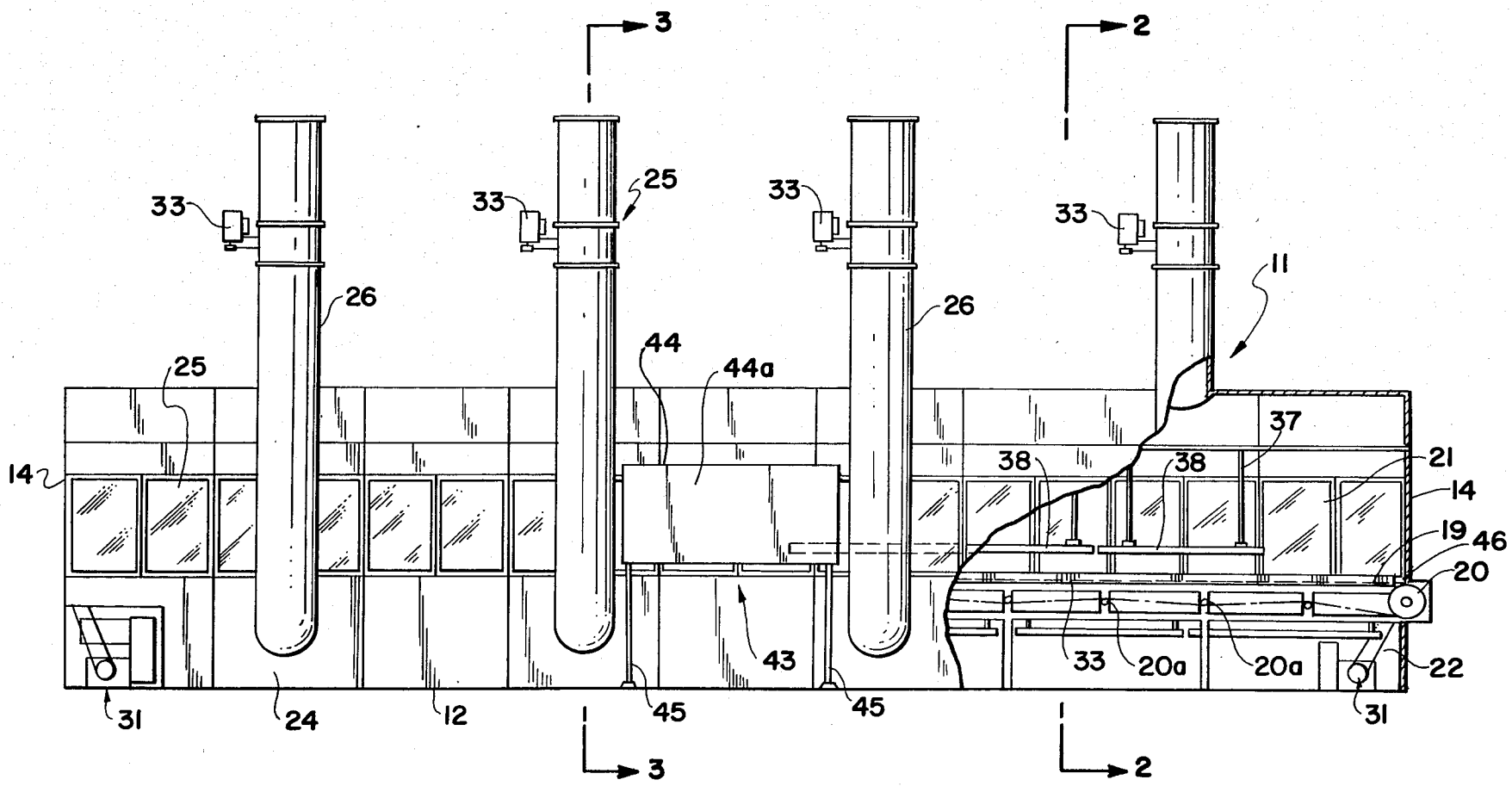
FIG. 1 shows a longitudinal side elevational view of the apparatus of the invention also showing a cut-away section of the front end thereof.
Figure 2:
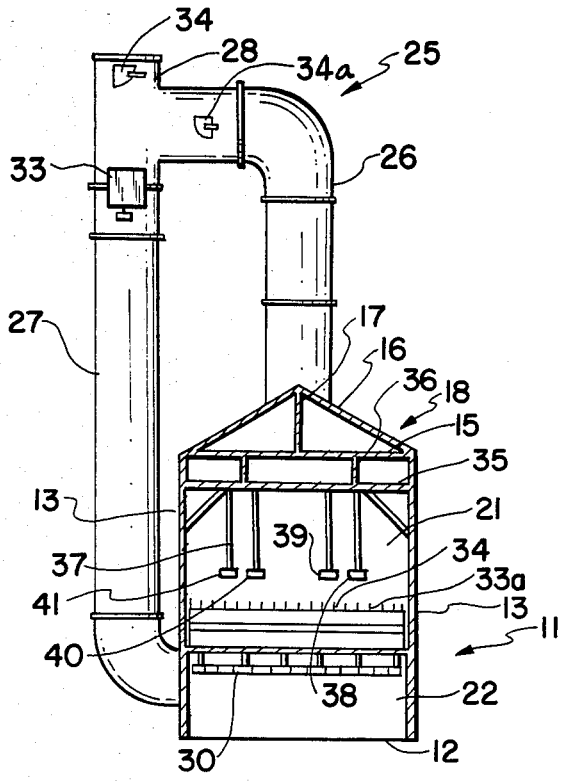
FIG. 2 is a partial sectional view through the plane indicated by the line 2—2 of FIG. 1.
Figure 3:
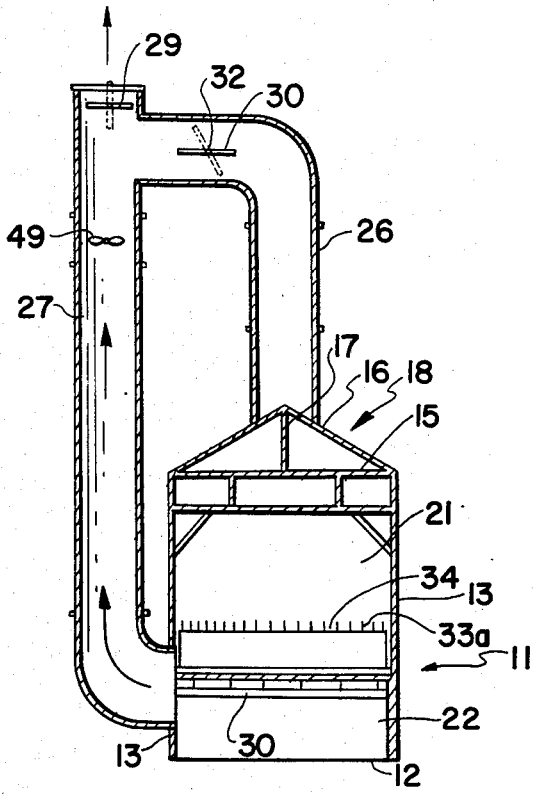
FIG. 3 is a sectional view through the plane indicated by line 3—3 of FIG. 1.

The apparatus of the invention as shown in FIGS. 1 to 3 comprises a housing indicated generally by 11, having a bottom 12, a pair of elongated side walls 13, (FIG. 2) a pair of end walls 14 (FIG. 1) and a top wall 15. (FIGS. 2 & 3) The side walls comprise a plurality of doors 24, which can be removed if required, having windows 25.

Figure 4:
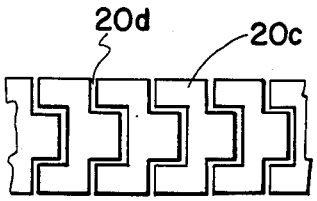
FIG. 4 is a top view of the feet of the conveyor shown in FIG. 1.

The top wall 15 supports roof members 16 and central strut 17 which together define "A" roof 18 above the housing. A series of conveyor belts 19 are mounted horizontally in the housing which extend laterally between the side-walls 14. These conveyor belts are arranged side-by-side in rows 34 and adjacent rows move in opposite directions between the end walls. A portion of a typical conveyor belt is shown in FIG. 4. Referring again to FIG. 1, conventional drive means for the conveyor shown generally by 31 comprising a motor and belt drive are located at each end of the housing. The belt drive of each drive means is connected to a driver mounted on a shaft extending between the sidewalls 13. Alternately mounted along the shaft at intervals corresponding to rows 34 are a driver roller or sprocket 20 and an idler roller (not shown) such that during rotation of the shaft by each of the drive means, every other conveyor belt row over the shaft is driven in one direction by driver rollers or sprockets while the remaining adjacent belt rows are moved in the opposite direction by the other shaft. The idler rollers serve to support and allow movement of conveyor belt rows by an opposite shaft. Idler rollers **20*a*** are also located at intervals along the side-walls.

The top of the conveyor belt feet **20*c* are shown in FIG. 4. The bottom of the feet are connected by a chain (not shown) which is engaged by a drive sprocket on one of the conveyor shafts. There is located an air space 20*d*** between each pair of conveyor feet the function of which will be described below.

The conveyor belts act as a partition, dividing the housing into an upper chamber 21 and a lower chamber 22. A plurality of heat exchanger elements 30 are located in the lower chamber, through which a hot or cold fluid may be introduced.

A plurality of forced air ducts 55 disposed at intervals spaced-apart along the length of the housing each comprise an inlet section 26 which extends vertically through the roof 18 and top wall 15 into the upper chamber 21, and an outlet section 27 which extends upwardly from the lower chamber 22. Each of the inlet and outlet sections are joined at air conduit 28 which opens to the atmosphere.

Each of the air conduits 28 and inlet sections 26 are equipped with louvres 29 and 30, louvre 29 located in air conduit 28, and louvre 30 located in inlet section 26. (See FIG. 3) Each louvre shaft 32 of these louvres is pivotably connected to louvre control mechanisms 54 and **54*a* mounted on the outside of the air conduit and inlet sections, respectively. A forced air blower motor 53 is located in outlet section 27 and drives air circulating fan 49**.

During operation the louvres are set as shown in FIG. 3; that is, louvre 29 is set to the vertical, and lourvre 30 is set at an angle to restrict the flow of air to the housing in inlet section 26. When the blower is operated air flow is that indicated by the arrows in FIG. 3. The flow of air to the upper chamber 21 in inlet section 26 is restricted; but the flow of air from the lower chamber 22 through outlet section 27 is not, thus creating a reduced or negative pressure in the housing. It is also possible to create a reduced pressure in the housing by employing inlet sections 26 which have a total cross-sectional area less than the total area of the air spaces **20*d* between the conveyor feet. This will insure that less air can be admitted to the housing than can be withdrawn from the lower chamber thereof, thus creating a reduced pressure. In such case, each of louvres 30** can be set to the horizontal; or the inlet section itself can be removed. A pressure differential of ¼ inch to 1½ inches is suitable (water gauge).

The pressure in the upper chamber 21 and lower chamber 22 is equalized by virtue of the spaces between the conveyor feet as discussed in connection with FIG. 4. As equalization occurs air flows downwardly from the upper chamber to the lower chamber. This air flow removes heat from the wax-based material in the containers as they pass through the housing, thereby enhancing solidification.

Air passing through the lower chamber can be heated or cooled by heat exchanger elements 30; and the resulting heated or cooled air therefrom can be recirculated, if necessary, to the housing by closing louvre 29 to the atmosphere.

It has been found advantageous to maintain the temperature of the housing constant in order ot obtain a satisfactory product. However, the temperature to be maintained varies with the nature of the waxy material and its melting and solidification characteristics. When finishing certain filled deodorant stick containers, for example, it is preferred to maintain the housing air temperature at about 80° F., and therefore, air is recirculated while being heated by the heat exchanger elements in the lower chamber. A plurality of separators **33*a* are located above the conveyor belts between the rows 34 thereof. Containers filled with wax-based material are linked up one behind the other in these rows between separators and move in a back and forth direction parallel to the side-walls as the conveyors are operated with containers in one row moving in a direction opposite to the direction of movement of containers in an adjacent row. Containers enter the oven from the right of FIG. 1 at 46**; and movement in rows occurs from right to left in FIGS. 2 & 3.

Co-extensive with and spaced-apart below top wall 15 is support member 35 with supporting beams 36 being mounted therebetween. Suspended from support member 35 on support brackets 37 are heating units 38, 39 40 & 41 which may be infrared heaters, for example. Heating unit 38, also called a first remelt unit, comprises a bank of three separate heating elements and is located over about the fifth row near the inlet side of the housing. Heating unit 39, also referred to as the second remelt unit, is a single heater located over about the sixth row and aligned with the middle element of the first remelt unit. Heating unit 40, also referred to as the third remelt unit, is located over the thirteenth row and aligned with the second remelt unit. Heating unit 41, also called a polisher, is located over about the fifteenth row and aligned with the third remelt unit. The temperature below the first remelt unit is preferably the highest of the four heating units, and is of sufficient magnitude to quickly melt the surface of wax-based material in the container. Each successive remelt unit preferably develops temperatures below that of a preceeding remelt unit with the polisher having the lowest temperature of all. All successive remelt units and polisher units however, develop temperatures sufficient to melt wax-based material, e.g. from about 100° C. to 650° C. However, earlier remelt units cause remelting of wax-based material at a faster rate and raise the temperature of the remelted surface to a higher degree than latter remelt units or the polisher. Alternatively, it is possible to maintain all heating units at the same temperature or at different temperatures not necessarily in descending order provided these temperatures are at least sufficient to melt the surface of wax-based material. In such case the residence time of each container under each heating unit can be increased or decreased until the desired result is achieved.

A control station indicated generally by 43 (FIG. 1) is located at the central portion of side wall 13, the station consisting of a rectangular box 44 having an inner window 44*a* extending into the oven a distance of a few rows supported by a pair of stanchions 45. A portion of the conveyor belts pass outwardly of the inner window. The control station allows inspection of the filled containers as they make their first pass in the housing in the first rows of the conveyors.

Operation of the apparatus is as follows:

Containers filled with wax-based material enter the housing at inlet point 46 and move from right to left to pass through control station 43 where they are inspected for major flaws such as incomplete filling, overfilling, dirt accumulations or any other flaw which remelting according to the invention will not cure. Thereafter, the containers move back and forth in the rows 34 until the first remelt unit 38 is encountered. This unit, comprising three elements, achieves the highest temperatures of all units and quickly melts the surface portion of the exposed waxy material. After passing out from under this unit the containers travel for three or four rows before passing under the second remelt unit 39, during which time the surface resolidifies and the undesirable surface characteristics previously present are removed to a large extent. After passing under the second remelt unit, which is a single element unit achieving temperatures less than the first remelt unit, the surface portion of the waxy material is again remelted. The material resolidifies again in its travel to the third remelt unit, several rows away. The surface of the waxy material in this resolidification is further perfected. On encountering the third remelt unit, which achieves temperatures less than the second remelt unit, the waxy material is again remelted. After solidifying again on its passage to the polisher the surface of the waxy material is even further perfected. After passing under the polisher 41, which achieves the lowest temperature of all the heating elements, the surface of the material is remelted for the last time and resolidified again before exiting the housing at the opposite side of entry point 46. The polisher is the mildest remelt stage and is meant to cure any minor surface deficiencies not cured by earlier heating units.

It should be mentioned that it may not be necessary in many cases for the filled containers to be exposed to all remelt units. Many surfaces will be satisfactorily improved by the first pass or the second pass under the first and second remelt units. Having all containers pass under all heating units, however inures substantially complete surface improvement.

While the invention has been described with reference to its preferred embodiment thereof it will be appreciated by those of ordinary skill in the art that various changes can be made without departing from the scope of the invention and such modifications are intended to be included within the scope of the claims.

I claim:

1. An apparatus for improving the characteristics of a stick or cake of solidified wax-based low melting material having a housing with an entrance and an exit; a horizontally-mounted endless conveyor means within the housing and heating means interposed into said housing and constructed to heat a first preselected position along said path of the conveyor, the improvement which comprises:

a. said conveyor means supporting on its upper surface a plurality of containers for sticks or cakes of said solidified wax-based material arranged in aligned relation along the length of the conveyor means;

b. driving means for progressively moving said conveyor means to propel said containers along a path from said entrance to said exit;

c. said heating means designed to heat the preselected position to a first temperature sufficient to at least partially melt said low-melting wax-based material;

d. means comprising separators mounted along said path for insulating said first preselected position from another area below the melting point of said wax-based material, whereby said wax-based material at least partially melts at said first preselected position and resolidifies in said other area;

e. means maintaining said chamber under reduced pressure;

f. an about vertical air feed conduit attached to a top of the housing; and g. a discharge conduit attached near a bottom of the housing.

2. The combination in accordance with claim 1 which includes heat exchange means disposed adjacent said conveyor means including the circulation of air and water maintaining said other area at a substantially uniform temperature below the melting temperature of said wax-based material.

3. An apparatus in accordance with claim 1 wherein said heating means comprises a plurality of heaters respectively disposed at a plurality of preselected positions spaced-apart along said path, said heaters constructed to produce a series of temperatures above said first melting temperatures at said respective preselected positions along said path between said entrance and said exit.

4. An apparatus in accordance with claim 3 wherein said heaters are constructed to produce a series of temperatures all above said first melting temperature, at said preselected positions, which progressively decrease from high to low along the length of said path between said entrance and said exit.

5. The combination in accordance with claim 3 wherein each of said preselected positions is heated to a temperature between about 650° C. and 1000° C., and wherein said other areas intervening between said preselected positions are maintained at a temperature not exceeding about 80° C.

6. The combination in accordance with claim 1 wherein said conveyor means is constructed to provide a horizontal plane separating said housing into two chambers, a first said chamber above said conveyor means and a second chamber below said conveyor means;

said conveyor means including along its length a plurality of slits for passing air currents between said first and second chambers;

means comprising a system of air ducts including a first air duct connected to said first chamber and a second air duct connected to said second chamber, said first and second air ducts being interconnected through a third duct to the atmosphere;

driving means comprising a motorized blower located in said system of air ducts for controlling the flow of air in said system; and valve means for separately controlling the flow of air into and out of said first and third ducts, for alternatively opening said third duct for exhausting air to the atmosphere from said housing and closing said first duct to said first chamber to reduce the pressure in said housing below atmospheric pressure, or for closing said third duct to the atmosphere and opening said first duct to recirculate air through said housing.

7. The combination in accordance with claim 1 wherein said conveyor means comprises a plurality of interconnected rows of conveyors with adjacent rows arranged to move in opposite directions through said housing, and wherein said means comprising separators comprises a plurality of separators respectively mounted between adjacent rows of said conveyor.

8. An apparatus for improving the surface of a body of wax-based low melting material comprising a housing;

an entrance port disposed at the housing;

an exit port disposed at the housing;

an about vertical air feed conduit attached to a top of the housing;

means for feeding air downward in the about vertical air conduit;

an endless horizontally mounted conveyor means running within the housing for transporting bodies in the direction from the entrance port to the exit port;

heating means disposed in the housing at a level above the conveyor and near the path of the air coming from the about vertical conduit to heat a first preselected position along said path of the conveyor means providing thermal energy to the bodies sufficiently to at least partially melt said low melting wax-based material;

separating means mounted along said path for insulating said first preselected position from another area spaced apart from said first preselected position along said path and constructed to reduce the temperature in said other area and maintain said temperature in said other area below the melting point of said wax based material, whereby said wax-based material at least partially melts at said first preselected position and resolidifies in said other area; means for maintaining said chamber under reduced pressure; a plurality of containers supported on the conveyor means for carrying bodies of said solidified wax-based material along the length of the conveyor means;

driving means at the conveyor means for progressively moving said containers along a path from said entrance port to said exit port;

a discharge conduit attached near a bottom of the housing.

9. The apparatus for improving the surface of a body of a wax-based low melting material according to claim 8 comprising means for feeding forced air downward in the vertical air feed conduit;

louver means disposed in the air feed conduit for allowing to partial closure of the air feed conduit such that the pressure in the air feed conduit is less than the pressure in the air discharge conduit.

10. The apparatus for improving the surface of a body of a wax-based low melting material according to claim 9 comprising a duct connection between the air feed conduit and the air discharge conduit such that part of the air discharged can be recycled to the air feed conduit; and a circulating fan disposed in the air discharge conduit for providing a reduced pressure in the housing.

11. The apparatus for improving the surface of a body of wax-based low melting material according to claim 10 comprising an A-roof forming the upper part of the housing for connection to the air feed conduit.

12. The apparatus for improving the surface of a body of a wax-based low melting material according to claim 10 comprising support members running about horizontally and attached to the housing and disposed in the upper part of the housing; suspended beams mounted between the support members;

about vertically elongated support brackets mounted to the support members; and heating units attached near the lower end of the support brackets.

13. The apparatus for improving the surface of a body of a wax-based low melting material according to claim 10 comprising heat exchange means disposed adjacent to said conveyor for maintaining a substantially uniform temperature in a respective area of said moving containers and wherein the heating means includes a plurality of heaters respectively disposed at a plurality of preselected positions along said path and wherein said heaters are constructed to produce a sequence of temperatures above said first melting temperatures at said respective preselected positions along said path between said entrance port and said exit port.

14. The apparatus for improving the surface of a body of a wax-based low melting material according to claim 10 comprising a duct conduit connecting said duct connection to the atmosphere wherein said conveyor is constructed to provide a horizontal plane separating said housing into two chambers, a first said chamber above said conveyor means and a second chamber below said conveyor;

driving means comprising a motorized blower located in said system of air ducts for controlling the flow of air in said system;

valve means for separately controlling the flow of air into and out of said feed conduit and discharge conduit for alternatively opening said duct conduit for exhausting air to the atmosphere from said housing and closing said feed conduit to said first chamber to reduce the pressure in said housing below atmospheric pressure, or for closing said duct conduit to the atmosphere and opening said feed conduit to recirculate air through said housing; and wherein said conveyor includes along its length a plurality of slits for passing air currents between said first and second chambers.

15. The apparatus for improving the surface of a body of a wax-based low melting material according to claim 10 wherein said conveyor comprises a plurality of interconnected rows of conveyors with adjacent rows arranged to move in opposite directions through said housing, and wherein said separating means comprising separators comprises a plurality of separators respectively mounted between adjacent rows of said conveyor.

16. The apparatus for improving the surface of a body of a wax-based low melting material according to claim 10 wherein the heating means comprises a first remelt unit, a second remelt unit, a third remelt unit, and a polisher.

17. The apparatus for improving the surface of a body of a wax-based low melting material according to claim 10 further comprising a control station for inspecting filled containers as they make their first pass in the housing including a rectangular box extending into the housing a few rows, a pair of stanchions supporting the rectangular box, such that a portion of the conveyor is disposed outwardly of the inner window.

* * * * *